US005135643A

United States Patent [19]

Ward

[11] Patent Number: 5,135,643

[45] Date of Patent: Aug. 4, 1992

[54] PROCESS FOR PRODUCING AROMATIC COMPOUNDS

[75] Inventor: John W. Ward, Yorba Linda, Calif.

[73] Assignee: Union Oil Company of California, Los Angeles, Calif.

[21] Appl. No.: 590,001

[22] Filed: Sep. 28, 1990

[51] Int. Cl.[5] ..... C10G 39/00

[52] U.S. Cl. ..... 208/137; 208/134; 208/135; 585/417; 585/418

[58] Field of Search ..... 208/137; 585/417, 418

[56] References Cited

U.S. PATENT DOCUMENTS

| | | | |
|---|---|---|---|
| Re. 31,919 | 6/1985 | Butter et al. | 502/66 |
| 2,212,026 | 8/1940 | Komarewsky | 585/418 |
| 3,651,164 | 3/1972 | Tabler | 208/137 |
| 3,941,871 | 3/1976 | Dwyer | 423/326 |
| 4,167,472 | 9/1979 | Dick et al. | 585/418 |
| 4,247,388 | 1/1981 | Banta et al. | 208/111 |
| 4,320,240 | 3/1982 | Love | 208/137 |
| 4,347,394 | 8/1982 | Dentz et al. | 585/417 |
| 4,358,363 | 11/1982 | Smith | 208/91 |
| 4,362,653 | 12/1982 | Robinson | 252/455 R |
| 4,524,230 | 6/1985 | Haensel | 208/137 |
| 4,652,360 | 3/1987 | Dessau | 208/137 |
| 4,704,494 | 11/1987 | Inui | 585/417 |
| 4,744,885 | 5/1988 | Messina et al. | 208/137 |
| 4,795,846 | 1/1989 | Zmich et al. | 208/137 |
| 4,822,941 | 4/1989 | Baillargeon et al. | 585/417 |
| 4,867,861 | 9/1989 | Abdo et al. . | |
| 4,933,310 | 6/1990 | Aufdembrink et al. | 502/71 |
| 4,950,385 | 8/1990 | Sivasanker et al. | 208/137 |
| 4,956,510 | 9/1990 | Harandi | 208/137 |
| 5,008,481 | 4/1991 | Johnson et al. | 585/418 |
| 5,019,664 | 5/1991 | Del Rossi et al. | 585/418 |

FOREIGN PATENT DOCUMENTS 0035807 9/1981 European Pat. Off. .

*Primary Examiner*—Helane Myers

*Attorney, Agent, or Firm*—Yale S. Finkle; Gregory F. Wirzbicki

[57] ABSTRACT

The concentration of aromatics in a hydrocarbon feedstock, preferably a diesel oil, is increased by contacting the feedstock in the presence of hydrogen at an elevated temperature and pressure with a catalyst devoid of Group VIB metal components and comprising nickel and/or cobalt components supported on a mixture of one or more amorphous, inorganic, refractory oxide components and an acidic, crystalline, intermediate pore molecular sieve, preferably a mixture of alumina and silicalite.

48 Claims, No Drawings

PROCESS FOR PRODUCING AROMATIC COMPOUNDS

BACKGROUND OF THE INVENTION

This invention relates to a process for increasing the concentration of aromatics in a hydrocarbon feedstock which contains paraffins by converting or dehydrocyclizing the paraffins into aromatic compounds. It is particularly concerned with a catalytic process carried out at relatively low temperatures in which the catalyst contains nickel and/or cobalt components but no tungsten or other Group VIB metal components and the feedstock boils in the diesel range.

Relatively high molecular weight aromatic compounds, such as those containing 12 or more carbon atoms, are in high demand in the petrochemical industry for use as solvents or as high valued intermediates in the formation of many different types of products including plastics and fabric dyes. As an example, naphthalene is a highly desired intermediate for making phthalic anhydride, naphthol, naphthol derivatives and dyes and finds direct use as a solvent. Anthracene is used directly in making dyes and in printing applications.

The major source of aromatic compounds for use in the petrochemical industry is the catalytic reforming of gasoline or other naphtha boiling range hydrocarbons. Unfortunately, the catalytic reforming of gasoline to make aromatic compounds has two major drawbacks. First, it decreases the amount of lower boiling hydrocarbons available for use as gasoline, which is in high demand as a fuel, and secondly, it results primarily in the production of lower molecular weight aromatics such as benzene, toluene and xylene. Although higher molecular weight aromatics such as naphthalene and anthracene can be derived from coal tar, the use of this source of aromatics is steadily declining. Thus, there exists a current need for the production of aromatic compounds from sources other than gasoline, naphtha, and coal tars via a process which has high selectivities for aromatics, particularly higher molecular weight aromatics containing 12 or more carbon atoms.

SUMMARY OF THE INVENTION

The present invention provides an improved process for producing aromatics by efficiently increasing the aromatics content of hydrocarbon feedstocks which contain paraffins, particularly feedstocks boiling in the diesel range. In accordance with the invention, it has been surprisingly found that the aromatics content of such feedstocks can be increased via the dehydrocyclization of paraffins by contacting the feedstock in the presence of hydrogen with a catalyst comprising (1) an acidic, crystalline, intermediate pore molecular sieve having aromatization activity and (2) a Group VIII metal hydrogenation component containing nickel and/or cobalt without the need for the catalyst to contain a tungsten component or other Group VIB metal component and, preferably, in the absence of a Group VIII metal component other than nickel and cobalt. It has been found that such catalysts have a significantly increased aromatization activity which enables them to produce a hydrocarbon product having a higher concentration of aromatics than is possible using similar catalysts which contain, in addition to nickel and/or cobalt, up to 30 weight percent, tungsten components, calculated as $WO_3$. It has been found that the use of such catalysts to treat feedstocks which boil in the diesel range, i.e., those feedstocks which typically have an initial boiling point in the range between about 410° and 470° F. and a final boiling point in the range between about 610° F. and 720° F., at temperatures significantly below those typically used in reforming and dehydrocyclization processes to increase gasoline octane, results in the production of a 300° F.+ boiling product which contains about twice the concentration of aromatics as compared to the original feedstock. Such high production of aromatics at relatively low temperatures serves as an economical source of aromatics, particularly high molecular weight aromatics, needed in the petrochemical industry.

A preferred catalyst for use in the process of the invention typically contains less than about 12 weight percent nickel components, calculated as NiO, impregnated on a support comprising a mixture of an amorphous, inorganic refractory oxide and the crystalline silica, intermediate pore, nonzeolitic molecular sieve known as silicalite. In a preferred embodiment, the catalyst contains between about 2 and 8 weight percent nickel components, calculated at NiO, and the amorphous refractory oxide is alumina, all or a portion of which serves as a binder for the silicalite. The product hydrocarbon from the process of the invention normally has boiling characteristics somewhat similar to the feedstock being treated; i.e., the process of the invention has little effect on the boiling range of the branched chain and non-alkylated aromatic hydrocarbons present in the feed. The catalyst selectively converts the straight chain and slightly branched chain paraffins into aromatic compounds.

DETAILED DESCRIPTION OF THE DESCRIPTION

Although any hydrocarbon feedstock which contains straight and slightly branched paraffins can be treated in accordance with the process of the invention, the preferred feedstock is one which boils in the diesel range and therefore contains little if any constituents which are typically regarded as components of gasoline or naphtha. The feedstock will typically have an initial boiling point at atmospheric pressure between about 410° F. and 470° F., preferably between about 420° and 450° F., and a final boiling point between about 610° F. and 720° F., normally between about 630° F. and 670° F. In general, about 90 volume percent of the feedstock will boil above about 440° F., preferably above about 460° F., while about 90 volume percent will boil below about 690° F., preferably below about 660° F. Usually, the feedstock will have a normal paraffin concentration of greater than about 7 weight percent, preferably greater than about 10 weight percent, with the concentration typically ranging between about 7 and 40 weight percent. The aromatics concentration of the feedstock is usually below about 50 volume percent, preferably below about 30 volume percent, as determined by the Fluorescent Indicator Adsorption (FIA) method (ASTM D 1319-65T). Typically, the hydrocarbon feedstock will be substantially free of straight and branched chain paraffins containing 6 or less carbon atoms including all $C_3$ and $C_4$ saturated compounds. More preferably, however, the feedstock will be substantially devoid of all straight and branched chain paraffins containing 12 or less carbon atoms.

If the hydrocarbon feedstock which is to be subjected to the process of the invention has a relatively small concentration of nitrogen and sulfur, it can normally be passed directly into the aromatization reactor where it is contacted in the presence of hydrogen with the catalyst. If, however, the feedstock contains relatively high concentrations of organonitrogen and/or organosulfur compounds, it may need to be upgraded by hydrotreatment prior to being subjected to aromatization. Typically, feedstocks which contain greater than about 0.3 weight percent sulfur, calculated as the element, and/or greater than about 0.01 weight percent nitrogen, calculated as the element, should be subjected to hydrotreatment to reduce concentrations of organosulfur and/or organonitrogen compounds prior to passage into the aromatization reactor.

If a hydrotreatment step is included in the process of the invention, it will typically be carried out at normal hydrogenation conditions of elevated temperature and pressure in a conventional hydrotreating reactor in which the liquid feed is passed downwardly through a packed bed of conventional hydrotreating catalyst. Such a catalyst normally comprises an alumina or a silica-alumina support carrying one or more Group VIII metal components and one or more Group VIB metal components in the form of an oxide or a sulfide. Combinations of one or more Group VIB metal oxides or sulfides with one or more Group VIII metal oxides or sulfides are generally preferred. Normally, the preferred matal constituents are either tungsten or molybdenum constituents in combination with either nickel or cobalt components. In addition to a Group VIB metal component and a Group VIII metal component, the hydrotreating catalyst may also contain a phosphorus component. Examples of such hydrotreating catalysts can be found in U.S. Pat. Nos. 4,879,265 and 4,886,582, the disclosures of which are hereby incorporated by reference in their entireties.

In accordance with the process of the invention, the hydrocarbon feedstock, which may contain all or a portion of the effluent from a hydrotreating reactor, is passed, normally in the absence of oxygen gas and carbon monoxide, into an aromatization reactor where it is directed downwardly through a bed of catalyst in the presence of hydrogen at elevated temperature and pressure. It has been surprisingly found that the particular catalyst used in the reactor allows the temperature in the reactor to be maintained below the temperatures normally required to convert paraffins into aromatics using conventional reforming or dehydrocyclization catalysts, i.e., temperatures above about 800° F. The temperature in the reactor typically ranges between about 500° F. and about 750° F., preferably between about 550° F. and 700° F., and most preferably between about 600° F. and 675° F. The ability of the process of the invention to be carried out at such low temperatures results in reduced energy costs and imbues the process of the invention with an economical advantage over operations carried out in the presence of conventional reforming and dehydrocyclization catalysts.

The pressure in the aromatization reactor will typically range between about 500 p.s.i.g. and 3000 p.s.i.g., preferably between about 750 p.s.i.g. and about 1500 p.s.i.g. The rate at which the feedstock is passed through the reactor in contact with the catalyst particles is typically set at a liquid hourly space velocity between about 0.3 and about 8.0 reciprocal hours, preferably between about 0.5 and 3.0. The hydrogen flow rate through the reactor is generally greater than about 500 standard cubic feet per barrel of feedstock, preferably between about 1500 and 10,000 standard cubic feet per barrel. In some cases, it may be preferable to remove all or a substantial proportion of the ammonia and hydrogen sulfide from the effluent exiting the hydrotreating reactor before the effluent is passed into the aromatization reactor.

The catalyst used in the aromatization reactor comprises a nickel and/or cobalt component supported on an acidic, crystalline, intermediate pore, nonzeolitic or zeolitic molecular sieve, which sieve typically is mixed with and/or bound together by an amorphous, inorganic refractory oxide. The term "molecular sieve" as used herein refers to any material capable of separating atoxs or molecules based on their respective dimensions. Molecular sieves include zeolites, microporous carbons, porous membranes, aluminas and the like. The term "pore size" as used herein refers to the diameter of the largest molecule that can be sorbed by the particular molecular sieve in question. The measurement of such diameters and pore sizes is discussed more fully in Chapter 8 of the book entitled "Zeolite Molecular Sieves" written by D. W. Breck and published by John Wiley & Sons in 1974, the disclosure of which book is hereby incorporated by reference in its entirety. The term "nonzeolitic" as used herein refers to molecular sieves whose frameworks are not formed of substantially only silicon and aluminum atoms in tetrahedral coordination with oxygen atoms. The term "zeolitic" as used herein refers to molecular sieves whose frameworks are formed of substantially only silicon and aluminum atoms in tetrahedral coordination with oxygen atoxs, such as the frameworks present in ZSM-5 type zeolites, Y zeolites and X zeolites.

It has been surprisingly found that the catalysts described above, which comprise a hydrogenation metal constituent containing a nickel component but no tungsten or other Group VIB metal component, are unexpectedly more active for aromatization than similar catalysts which contain both a nickel hydrogenation component and a tungsten hydrogenation component. It has been found that such tungsten-free catalysts are able to produce, at much lower temperatures than are normally needed to produce aromatics via conventional reforming or dehydrocyclization processes, a hydrocarbon product having a much higher concentration of aromatic compounds than that obtained using similar catalysts which contain tungsten components.

The nickel and/or cobalt components that comprise the hydrogenation constituent of the aromatization catalyst will normally be present in the form of the metal, the metal oxide or the metal sulfide, and will typically comprise less than about 12 weight percent, calculated as NiO and/or CoO, of the catalyst. Typically, the catalyst will contain between about 1 and about 9.5 weight percent nickel and/or cobalt components, calculated as NiO and CoO, preferably between about 2 and about 8 weight percent, and most preferably between about 3.5 and 6.0 weight percent. As mentioned previously, nickel and/or cobalt components will normally be the only hydrogenation metal components present in the catalyst. The catalyst is typically substantially devoid of tungsten components, other Group VIB metal hydrogenation components, and Group VIII metal hydrogenation components other than nickel and cobalt components.

The intermediate pore, crystalline molecular sieve component of the aromatization catalyst may be zeolitic or nonzeolitic, has a pore size between about 5.0 and 7.0 angstroms, is acidic and therefore possesses catalytic activity, and is normally comprised of 10-membered rings of oxygen atoms. In general, the intermediate pore molecular sieve will selectively sorb n-hexane over 2,2-dimethylbutane. Examples of zeolitic, crystalline, intermediate pore molecular sieves which can be used in the catalyst include crystalline aluminosilicates of the ZSM-5 type. Examples of crystalline, nonzeolitic molecular sieves which may be used in the catalyst include crystalline silicas, silicoaluminophosphates, chromosilicates, aluminophosphates, titanium aluminosilicates, titanium aluminophosphates, galliosilicates, ferrosilicates and borosilicates, provided, of course, that the particular sieve chosen has a pore size between about 5.0 and about 7.0 angstroms.

The silicoaluminophosphates which may be used as the intermediate pore, crystalline molecular sieve in the aromatization catalyst are nonzeolitic molecular sieves comprising a molecular framework of $[AlO_2]$, $[PO_2]$, and $[SiO_2]$ tetrahedral units. The different species of silicoaluminophosphate molecular sieves are referred to by the acronym SAPO-n, where "n" denotes a specific structure type as identified by X-ray powder diffraction. The various species of silicoaluminophosphates are described in detail in U.S. Pat. No. 4,440,871, the disclosure of which is hereby incorporated by reference in its entirety, and one use of these materials is disclosed in U.S. Pat. No. 4,512,875, also herein incorporated by reference in its entirety. The silicoaluminophosphates have varying pore sizes and only those that have pore sizes between about 5.0 and 7.0 angstroms may be used as the intermediate pore molecular sieve in the aromatization catalyst. Thus, typical examples of silicoaluminophosphates suitable for use in the catalysts are SAPO-11 and SAPO-41. The silicoaluminophosphates are also discussed in the article entitled "Silicoaluminophosphate Molecular Sieves: Another New Class of Microporous Crystalline Inorganic Solids" published in the *Journal of American Chemical Society*, vol. 106, pp. 6093–6095, 1984. This article is hereby incorporated by reference in its entirety.

Other nonzeolitic molecular sieves which can be used as the intermediate pore, crystalline molecular sieve in the catalyst are the crystalline aluminophosphates. These molecular sieves have a framework structure whose chemical composition expressed in terms of mole ratios of oxides is $Al_2O_3$: $1.0\pm0.2$ $P_2O_5$. The various species of aluminophosphates are designated by the acronym $ALPO_4$-n, where n denotes a specific structure type as identified by X-ray powder diffraction. The structure and preparation of the various species of aluminophosphates are discussed in U.S. Pat. Nos. 4,310,440 and 4,473,663, the disclosures of which are hereby incorporated by reference in their entireties. One useful crystalline aluminophosphate is $ALPO_4$-11.

Two other classes of nonzeolitic, intermediate pore, crystalline molecular sieves for use in the catalyst are borosilicates and chromosilicates. Borosilicates are described in U.S. Pat. Nos. 4,254,297, 4,269,813 and 4,327,236, the disclosures of which are hereby incorporated by reference in their entireties. Chromosilicates are described in detail in U.S. Pat. No. 4,405,502, the disclosure of which is also hereby incorporated by reference in its entirety.

Another class of nonzeolitic, intermediate pore, crystalline molecular sieves for use in the catalyst is the titanium aluminophosphates. Such materials are described in greater detail in U.S. Pat. No. 4,500,651, herein incorporated by reference in its entirety, and are designated by the acronym TAPO-n, where the "n" is an arbitrary number specific to a given member of the class. One such material which has a pore size of intermediate dimensions is TAPO-11.

Yet another class of nonzeolitic molecular sieves which can be utilized as the component of the catalyst used in the process of the invention is the titanium aluminosilicates, particularly those described under the acronym TASO-n, where, again, the "n" is an arbitrary number specific to a given member of the class. One such material having a pore size of intermediate dimension is TASO-45. Titanium aluminosilicates are described in detail in U.S. Pat. No. 4,707,345, the disclosure of which is hereby incorporated by reference in its entirety.

A preferable intermediate pore, nonzeolitic molecular sieve for use in the aromatization catalyst is a crystalline, silica molecular sieve essentially free of Group IIIA metals, in particular aluminum, gallium and boron, with the most preferred silica molecular sieve for use being a material known as silicalite, a silica polymorph that may be prepared by methods described in U.S. Pat. No. 4,061,724, the disclosure of which is hereby incorporated by reference in its entirety. The resulting silicalite may be subjected to combustion to remove organic materials and then treated to eliminate traces of alkali metal ions. Silicalite may be characterized as a crystalline molecular sieve comprising a channel system or pore structure of intersecting elliptical straight channels and nearly circular straight channels, with openings in both types of channels being defined by 10-membered rings of oxygen atoms. These openings are normally between about 5.0 and 6.0 angstroms in maximum cross-sectional dimension. Silicalite is a hydrophobic crystalline, silica molecular sieve having the property under ambient conditions of absorbing benzene, which has a kinetic diameter of 5.85 angstroms, while rejecting molecules larger than 6.0 angstroms such as neopentane which has a kinetic diameter of 6.2 angstroms. Silicalite is known to have an X-ray powder diffraction pattern similar to ZSM-5 zeolite, but recently new silicas having X-ray powder diffraction patterns similar to ZSM-11 zeolite have been discovered. While ZSM-11 type silicalites are contemplated for use herein, the preferred silicalite is that having an X-ray powder diffraction pattern similar to ZSM-5 zeolite, a mean refractive index of $1.39\pm0.01$ when calcined in air for 1 hour at 600° C. and a specific gravity between about 1.65 and 1.80 grams per cubic centimeter depending upon the method of preparation.

It should be emphasized that, although silicalite is similar to members of the ZSM-5 family of zeolites in having a similar X-ray powder diffraction pattern, it is dissimilar in two important aspects. First, silicalite is not a zeolite because it contains only trace proportions of alumina which are present due to the commercial impossibility of removing all contaminant aluminum components from reactants used to prepare silicalite. ZSM-5 type zeolites, on the other hand, are typically crystallized from hydrogels to which aluminum-containing reactants have been added and, therefore, usually contain substantially more than trace amounts of alumina, normally greater than 1.0 weight percent, calculated as $Al_2O_3$. Silicalite, however, will normally only contain between about 0.15 and about 0.75 weight percent alumina, calculated as $Al_2O_3$, with most silicalites containing less than about 0.6 weight percent. Secondly, as disclosed in U.S. Pat. No. 4,061,724, neither silicalite nor its precursors exhibit significant ion exchange properties. Thus, silicalite does not share the zeolitic property of substantial ion exchange common to crystalline aluminosilicate zeolites such as ZSM-5 zeolite.

In addition to the above-discussed nonzeolitic molecular sieves, zeolitic molecular sieves having an intermediate pore size may be used as the active acidic component of the catalyst. The preferred zeolitic molecular sieves are the crystalline aluminosilicates of the ZSM-5 family such as ZSM-5, ZSM-11, ZSM-12, ZSM-23, ZSM-35, ZSM-38 and the like. ZSM-5, ZSM-11, ZSM-12, ZSM-23, ZSM-35 and ZSM-38 are all known zeolites and are all fully described, respectively, in the following U.S. patents, the disclosures of which are hereby incorporated by reference in their entireties: U.S. Pat. Nos. 3,702,886; 3,709,979; 3,832,449; 4,076,842; 4,016,245 and 4,046,859. These zeolites are known to readily absorb benzene and normal paraffins such as n-hexane and also certain monobranched paraffins, such as isopentane, but have difficulty absorbing dibranched paraffins, such as 2,2-dimethylbutane. These zeolites are also known to have a crystal density of not less than 1.6 grams per cubic centimeter, a silica-to-alumina mole ratio of at least 12, and a constraint index within the range of 1 to 12. The constraint index is defined in U.S. Pat. No. 4,229,282, the disclosure of which is hereby incorporated by reference in its entirety. The foregoing zeolites are preferably utilized in the acid form by replacing at least some of the ion-exchanged metal cations in the zeolite with hydrogen ions. Prior to the ion exchange, however, the zeolite is typically subjected to combustion to remove organic materials. The ion exchange may then be accomplished directly with an acid or indirectly by ion exchange with ammonium ions followed by calcination to convert the ammonium ions to hydrogen ions. In either case, it is preferred that the exchange be such that a substantial proportion of the ion exchange sites of the zeolite utilized in the catalyst support is occupied with hydrogen ions.

Normally, the acidic, crystalline, intermediate pore molecular sieve is intimately mixed with one or more amorphous, inorganic, refractory oxide components to form a support upon which the nickel and/or cobalt hydrogenation metal component or components are subsequently deposited. The proportion of molecular sieve in the support typically varies in the range of 2 to 90 weight percent. In some cases it may be desirable that the support contain the intermediate pore molecular sieve in a minor proportion, usually between about 10 and 45 weight percent, and more usually between 20 and 40 weight percent, with 30 weight percent being highly preferred. In another embodiment of the invention, it is preferred that the intermediate pore molecular sieve comprise a major proportion of the support, usually between about 60 and about 90 weight percent, with 80 weight percent being preferred.

At least part of the refractory oxide portion of the support serves as a binder to hold the acidic molecular sieve component together in the support. A preferred refractory oxide for use as the binder is a dense, low porosity, gamma alumina formed by calcining peptized alumina that has been mixed with the molecular sieve. The binder will typically comprise between about 5 and 30 weight percent, usually between about 10 and 25 weight percent, of the support. When the support comprises a minor amount of the intermediate pore molecular sieve, it is preferred that the support contain a refractory oxide diluent in addition to the binder. This diluent may or may not possess some type of catalytic activity and will typically be an amorphous, inorganic refractory oxide such as silica, magnesia, silica-magnesia, zirconia, silica-zirconia, titania, silica-titania, alumina, silica-alumina and combinations thereof. The preferred refractory oxide for use as the diluent is an amorphous alumina, most preferably gamma alumina. Typically, the refractory oxide which comprises the diluent component of the support will have a surface area above about 50 $m^2$/gram. When an amorphous, inorganic, refractory oxide diluent is utilized as a component of the catalyst support, it will typically comprise between about 35 and 65 weight percent, preferably between about 45 and 55 weight percent, of the support.

The catalyst used in the process of the invention is preferably prepared in particulate form, with cylinders being a preferred shape. One convenient method for preparing the catalyst involves first comulling a wetted mixture of the acidic, intermediate pore, molecular sieve component and a precursor of the inorganic refractory oxide binder, usually peptized alumina, in proportions appropriate to what is desired in the final catalyst support. If a refractory oxide diluent is also desired, a precursor of it, such as an alumina gel, hydrated alumina, a silica-alumina hydrogel, a silica sol and the like, is also mixed with the molecular sieve. The comulled mixture is then extruded through a die having openings in the preferred shapes, normally circles, ellipses, three-leaf clovers or four-leaf clovers. Among preferred shapes for the die openings are ones that result in particles having surface-to-volume ratios greater than about 100 reciprocal inches. After extrusion, the catalyst support particles are cut into lengths of from 1/16 to ½ inch. The resulting particles are dried and calcined at an elevated temperature, normally between about 600° F. and 1600° F., to produce support particles of high crushing strength.

After calcination, the extruded support particles are impregnated with a liquid solution containing nickel and/or cobalt components in dissolved form, normally an aqueous solution of dissolved nickel nitrate and/or cobalt nitrate, or other soluble nickel or cobalt salt to form the catalyst particles. After impregnation, the particles are dried and then calcined in air at temperatures at or above 800° F. for a time period sufficient to convert the metal components to the oxide form. The resulting catalyst particles comprise nickel and/or cobalt components distributed rather evenly over the acidic, intermediate pore molecular sieve component and the amorphous, inorganic, refractory oxide or oxides.

Alternative methods of introducing the nickel and/or cobalt components into the catalyst include mixing an appropriate solid or liquid containing the components with the materials to be extruded through the die. Such a method may prove less expensive and more convenient on a commercial scale than the impregnation method and will also result in the metal components being intimately mixed with the acidic, crystalline, intermediate pore, molecular sieve component and the amorphous refractory oxide component of the support. Regardless of how the metal components are introduced into the catalyst, their concentration therein will be substantially greater, normally one and one-half to two times greater, than could be achieved by ion exchange with the intermediate pore, molecular sieve component of the catalyst.

It is preferred that the nickel and/or cobalt constituents of the catalyst be converted to the sulfide form prior to use. This may be accomplished by contacting the catalyst in the aromatization reactor with a gas stream consisting of hydrogen and about 10 volume percent hydrogen sulfide at an elevated temperature. Alternatively, if the feedstock with which the catalyst is to be contacted contains organosulfur components, the catalyst may be merely placed in service in the oxide form and under the conditions specified previously, the metal components of the catalyst will be readily converted to the sulfide form in situ. It should be understood, however, that the metal components of the catalyst can be converted to the sulfide form prior to the catalyst being loaded into the reactor by one of several techniques including the one described in U.S. Pat. No. 4,719,195, the disclosure of which is hereby incorporated by reference in its entirety.

Although the aromatization catalyst used in the process of the invention may contain more than one acidic crystalline, molecular sieve component in combination with one or more amorphous, refractory oxide components, it is preferable that only one nonzeolitic molecular sieve, preferably silicalite, be present. Also, the preferred catalyst contains nickel components and is essentially free of an acid halogen component such as fluorine or chlorine. Preferably then, the catalyst used in the process of the invention consists essentially of nickel components, an intermediate pore, nonzeolitic molecular sieve and one or more amorphous, inorganic, refractory oxide components.

The effluent from the aromatization reactor has a substantially higher concentration of aromatics as compared to the feedstock due to the selective conversion by the catalyst of straight and slightly branched chain paraffins in the hydrocarbon feedstock into aromatic compounds rather than into lower molecular weight nonaromatic compounds. Normally, the concentration by volume of aromatics as determined by FIA in the 300° F.+ boiling fraction of the effluent will be at least about 1.2 times, typically at least about 1.5 times and frequently at least about 1.8 times, the concentration by volume of aromatics in the feedstock. Usually the aromatics concentration by volume in the effluent will range between 1.2 and 2.0 times the concentration in the feedstock. The effluent will also have a cloud point and/or pour point that is substantially lower than that of the feedstock, usually between about 50° F. and 150° F. lower. When the feedstock to the aromatization reactor is a diesel oil which boils at temperatures above the gasoline boiling range and therefore contains higher molecular weight paraffins, the aromatic compounds in the reactor effluent will be in the higher molecular weight range. Thus, the use of diesel oil as a feed results in an effective process for producing aromatic compounds containing 12 or more carbon atoms.

The nature and objects of the invention are further illustrated by the following example, which is provided for illustrative purposes and not to limit the invention as defined by the claims. The example demonstrates that a catalyst containing nickel components and no Group VIB metal components supported on a mixture of silicalite and alumina is surprisingly more active for converting paraffins into aromatic compounds at relatively low temperatures than a similar catalyst containing a Group VIB metal.

EXAMPLE

An experimental catalyst for use in the process of the invention was prepared by mixing 80 weight percent silicalite with 20 weight percent peptized Catapal alumina and a sufficient amount of water to produce an extrudable paste. The silicalite used contained about 0.5 weight percent alumina, calculated as $Al_2O_3$. The mixture was mulled and then extruded through a 1/16 inch diameter die in the shape of cylinders. The extruded product was dried and then broken into particles varying in length up to ½ inch. These particles were then dried and calcined at 900° F. for 1 hour. The dried and calcined extrudate particles were impregnated with a sufficient amount of a nickel nitrate solution to saturate the pores of the extrudate particles. The nickel nitrate solution was prepared by dissolving 43 rams of nickel nitrate [$Ni(NO_3)_26H_2O$] in 56 ml of water. The resulting impregnated particles were dried and calcined at 900° F. to produce catalyst particles containing about 5 weight percent nickel components, calculated as NiO.

A comparative catalyst similar to ones disclosed in U.S. Pat. Nos. 4,428,862 and 4,790,927, the disclosures of which are incorporated herein by reference in their entireties, was prepared in the same manner as the experimental catalyst except the dried and calcined extrudate particles were impregnated by pore saturation with a solution containing both nickel nitrate and ammonium metatungstate. The impregnating solution was made by dissolving 55 grams of nickel nitrate and 67 grams of ammonium metatungstate into 86 ml of water. After these impregnated particles were dried and calcined, the resultant catalyst particles contained about 4 weight percent nickel components, calculated as NiO, and about 18 weight percent tungsten components, calculated as $WO_3$.

The experimental and comparative catalysts were evaluated for aromatization activity utilizing a diesel oil having the properties set forth in Table 1 below.

TABLE 1

PROPERTIES AND CHARACTERISTICS OF FEEDSTOCK

| | | Distillation, D-86 | |
|---|---|---|---|
| | | Vol % | °F. |
| Gravity, °API | 34.0 | IBP/5 | 430/444 |
| Cloud Point, °F. | 34 | 10/20 | 490/514 |
| Sulfur, Wt. % | 0.267 | 30/40 | 528/541 |
| Normal paraffins | 13.1 | 50/60 | 554/565 |
| $C_{13}$–$C_{36}$, Wt. % | | 70/80 | 579/>580 |
| FIA Aromatics, Vol. % | 27.5 | | |

About 110 grams of each catalyst was placed in a laboratory size downflow reactor vessel and presulfided by passing gas consisting of 90 volume percent hydrogen and 10 volume percent hydrogen sulfide through the catalyst bed. The temperature in the reactor during the presulfiding step was gradually increased from room temperature to 700° F. and held at this temperature for about four hours. At this point, the temperature was lowered to 450° F. and the diesel oil was passed into the reactor and through the bed of experimental or comparative catalyst at a liquid hourly space velocity of 1.0 reciprocal hours. The temperature in the reactor was raised from about 450° F. to about 630° F. at a rate of about 50° F. per hour and then maintained at 630° F. for three days. Hydrogen was passed through the reactor simultaneously with the diesel oil in an amount equal to 6000 standard cubic feet of hydrogen per barrel of oil. The pressure maintained in the reactor was 1000 p.s.i.g. After the reactor had been maintained at 630° F. for three days, the effluent product from the reactor was collected and fractionated utilizing an Oldershaw distillation. The temperature in the reactor was then raised to 660° F., and after three days the effluent was again collected and fractionated. The 300° F.+ boiling fraction from each distillation was analyzed for n-paraffins, cloud point, sulfur and aromatics. The results of these analyses are set forth in Table 2 below.

TABLE 2

| | Diesel | Experimental Catalyst | | Comparative Catalyst | |
|---|---|---|---|---|---|
| | Feed | 630° F. | 660° F. | 630° F. | 660° F. |
| N-Paraffins (Wt. %) | 13.1 | 0.7 | 1.0 | 11.5 | 9.0 |
| Aromatics (Vol. %, FIA) | 27.5 | 56.5 | 57.4 | 21.8 | 11.9 |
| Sulfur (Wt. %) | .267 | .25 | .21 | .0021 | .0020 |
| Cloud Point (°F.) | 34 | −72.4 | −76.0 | 32 | 6.8 |

As can be seen from Table 2, use of the comparative catalyst, which contained nickel and tungsten constituents supported on a mixture of silicalite and alumina, yielded, at both 630° F. and 660° F., a product whose 300° F.+ boiling fraction had a decreased concentration of aromatics as compared to the diesel feed, i.e., 21.8 and 11.9 volume percent, respectively, versus 27.5 volume percent. On the other hand, the 300° F.+ boiling product obtained using the experimental catalyst of the process of the invention, which did not contain tungsten components but was otherwise identical to the comparative catalyst, surprisingly yielded dramatically increased concentrations of aromatics at 630° F. and 660° F. as compared to the diesel feed, i.e., 56.5 and 57.4 volume percent, respectively, versus 27.5 volume percent. Although use of the comparative catalyst resulted in a decrease in the normal paraffin concentration of the 300° F.+ boiling fraction compared to the diesel feed, i.e., 11.5 and 9.0 weight percent versus 13.1 weight percent, use of the experimental catalyst resulted in vastly greater reductions, i.e. 0.7 and 1.0 weight percent versus 13.1 weight percent. The greater reduction in normal paraffin content obtained using the experimental catalyst of the process of the invention is also reflected by the much lower cloud points obtained using this catalyst in lieu of the comparative catalyst.

The above data clearly indicate that the tungsten-free catalysts used in the process of the invention are highly selective for the conversion of paraffins into aromatic compounds at temperatures, i.e., 630° F. and 660° F., that are considerably below those used in conventional reforming and dehydrocyclization processes to produce aromatics. The ability to operate at such low temperatures enables the process of the invention to be carried out at substantially reduced energy costs compared to more conventional processes for making aromatic compounds.

Although this invention has been described in conjunction with an example and by reference to several embodiments of the invention, it is evident that many alterations, modifications and variations will be apparent to those skilled in the art in light of the foregoing description. Accordingly, it is intended to embrace within the invention all such alternatives, modifications and variations that fall within the spirit and scope of the appended claims.

I claim:

1. A process for increasing the concentration of aromatics in a hydrocarbon feedstock containing greater than about 7.0 weight percent normal paraffins by converting at least a portion of said paraffins into aromatic compounds, which process comprises (1) contacting said feedstock in the presence of hydrogen at an elevated temperature and pressure in a contacting zone with a catalyst composition, said feedstock being substantially free of paraffins containing from 1 to 12 carbon atoms, and (2) recovering from said contacting zone a product hydrocarbon having a greater concentration of aromatic compounds as compared to the concentration in said feedstock, wherein said catalyst composition comprises:

(a) an acidic, crystalline, intermediate pore molecular sieve having a pore size between 5.0 and 7.0 angstroms; and (b) a hydrogenation component comprising a Group VIII metal component selected from the group consisting of nickel and cobalt components, said hydrogenation component being substantially devoid of Group VIB metal components.

2. A process as defined by claim 1 wherein said catalyst composition further comprises an amorphous, inorganic, refractory oxide binder.

3. A process as defined by claim 1 wherein said hydrocarbon feedstock is a diesel oil having an initial boiling point between about 410° F. and about 470° F. and a final boiling point between about 610° F. and about 720° F.

4. A process as defined by claim 3 wherein said intermediate pore molecular sieve is a zeolitic molecular sieve.

5. A process as defined by claim 4 wherein said zeolitic molecular sieve is a zeolite of the ZSM-5 family.

6. A process as defined by claim 5 wherein said zeolite of the ZSM-5 family is selected from the group consisting of ZSM-5, ZSM-11, ZSM-12, ZSM-23, ZSM-35 and ZSM-38.

7. A process as defined by claim 1 wherein said intermediate pore molecular sieve is a nonzeolitic molecular sieve.

8. A process as defined by claim 7 wherein said diate pore, nonzeolitic molecular sieve is a aluminophosphate molecular sieve.

9. A process as defined by claim 8 wherein said silicoaluminophosphate molecular sieve is SAPO-11 molecular sieve.

10. A process as defined by claim 7 wherein said intermediate pore, nonzeolitic molecular sieve is an aluminophosphate molecular sieve.

11. A process as defined by claim 10 wherein said aluminophosphate molecular sieve is AlPO-11 molecular sieve.

12. A process as defined by claim 7 wherein said intermediate pore, nonzeolitic molecular sieve is a titanium aluminophosphate molecular sieve.

13. A process as defined by claim 7 wherein said intermediate pore, nonzeolitic molecular sieve is a titanium aluminosilicate molecular sieve.

14. A process as defined by claim 7 wherein said intermediate pore, nonzeolitic molecular sieve is a crystalline silica polymorph.

15. A process as defined by claim 14 wherein said crystalline silica polymorph is silicalite.

16. A process as defined by claim 1 wherein said catalyst composition comprises less than about 12 weight percent of said Group VIII metal component calculated as the monoxide.

17. A process as defined by claim 16 wherein said Group VIII metal component comprises nickel.

18. A process as defined by claim 17 wherein said hydrogenation component contains nickel as essentially the only metal therein.

19. A process as defined by claim 17 wherein said nickel component comprises between about 2 and about 8 weight percent, calculated as NiO, of said catalyst composition.

20. A process as defined by claim 2 wherein said Group VIII metal component is supported on both said inorganic, refractory oxide binder and said molecular sieve.

21. A process as defined by claim 1 wherein about 90 volume percent of said hydrocarbon feedstock boils above about 440° F. and about 90 volume percent of said hydrocarbon feedstock boils below about 690° F.

22. A process as defined by claim 1 wherein the volume percent aromatics in the 300° F.+ boiling fraction of said product hydrocarbon as determined by Fluorescent Indicator Adsorption (FIA) is at least about 1.2 times greater than the volume percent aromatics in said feedstock.

23. A process as defined by claim 1 wherein said feedstock is contacted with said catalyst composition at a temperature between about 500° F. and 750° F.

24. A process as defined by claim 1 wherein said hydrogenation component is substantially free of Group VIII metal components other than nickel and cobalt components.

25. A process as defined by claim 1 wherein said hydrocarbon feedstock is contacted with said catalyst composition at a temperature between 550° F. and 700° F.

26. A process as defined by claim 7 wherein said hydrocarbon feedstock is a diesel oil having an initial boiling point between about 410° F. and 470° F. and a final boiling point between about 610° F. and 720° F.

27. A process for increasing the concentration of aromatics in a diesel oil feedstock by converting normal paraffins in said oil into aromatic compounds which comprises:

(a) contacting said oil in the presence of hydrocarbon at an elevated temperature between about 500° F. and 750° F. and at an elevated pressure with a catalyst composition comprising a nickel component on a support comprising acidic silicalite and an amorphous, inorganic, refractory oxide binder, wherein said catalyst composition contains between about 1 and about 9.5 weight percent nickel components, calculated as NiO, and is substantially devoid of Group VIB metal components; and (b) recovering a product hydrocarbon having a greater concentration of aromatic compounds as compared to the concentration in said diesel oil feedstock.

28. A process as defined by claim 27 wherein said inorganic, refractory oxide binder comprises alumina.

29. A process as defined by claim 27 wherein the 300° F.+ boiling fraction of said product hydrocarbon has a volume concentration of aromatic compounds as determined by Fluorescent Indicator Adsorption (FIA) at least about 1.5 times the volume concentration in said feedstock.

30. A process as defined by claim 27 wherein said catalyst composition comprises between about 3.5 and 6.0 weight percent nickel components, calculated as NiO.

31. A process as defined by claim 28 wherein said support consists essentially of alumina and silicalite.

32. A process as defined by claim 27 wherein said diesel oil feedstock has an initial boiling point between about 410° F. and about 470° F. and a final boiling point between about 610° F. and 720° F.

33. A process as defined by claim 27 wherein said support further comprises an amorphous, inorganic, refractory oxide diluent.

34. A process as defined by claim 33 wherein said support comprises between about 20 and 40 weight percent silicalite, between about 10 and 25 weight percent alumina binder and between about 35 and 65 weight percent amorphous, inorganic, refractory oxide diluent.

35. A process as defined by claim 27 wherein said support comprises between about 70 and 90 weight percent silicalite and between about 10 and 30 weight percent alumina binder.

36. A process as defined by claim 27 wherein said diesel oil feedstock contains less than about 30 volume percent aromatic compounds as determined by Fluorescent Indicator Adsorption (FIA).

37. A process as defined by claim 27 wherein said diesel oil feedstock is contacted with said catalyst composition at a temperature between about 550° F. and 750° F.

38. A process as defined by claim 27 wherein about 90 volume percent of said diesel oil feedstock boils above about 440° F. and about 90 volume percent boils below about 690° F.

39. A process as defined by claim 27 wherein said hydrocarbon feedstock as substantially free of paraffins containing from 1 to 12 carbon atoms.

40. A process as defined by claim 29 wherein said catalyst composition contains between about 2 and 8 weight percent nickel components, calculated as NiO.

41. A process for increasing the concentration of aromatics in a diesel oil feedstock containing organonitrogen components, organosulfur components and paraffins, which process comprises:

(a) contacting said diesel oil with hydrogen in the presence of a hydrotreating catalyst in a hydrotreating zone under conditions suoh that the concentration of organosulfur and organonitrogen compounds is reduced;

(b) contacting the effluent from said hydrotreating zone in the presence of hydrogen with a catalyst in a contacting zone under conditions such that at least a portion of said paraffins are converted into aromatic compounds, wherein said catalyst is substantially free of Group VIB metal components and comprises (1) between about 1 and 9.5 weight percent nickel components, calculated as NiO, (2) an essentially Group IIIA metal-free crystalline silica molecular sieve having pores defined by 10-membered rings of oxygen atoms and (3) an amorphous, inorganic, refractory oxide binder; and (c) recovering a product hydrocarbon having a decreased concentration of organonitrogen and organosulfur components and an increased concentration of aromatic compounds as compared to said diesel oil feedstock

42. A process as defined by claim 41 wherein said inorganic, refractory oxide binder comprises alumina.

43. A process as defined by claim 42 wherein said crystalline silica molecular sieve comprises silicalite.

44. A process as defined by claim 43 wherein the volume concentration of aromatic compounds as determined by Fluorescent Indicator Adsorption (FIA) in the 300° F.+ boiling fraction of said product hydrocarbon is at least about 1.8 times greater than the volume concentration in said diesel oil feedstock.

45. A process as defined by claim 41 wherein about 90 volume percent of said diesel oil feedstock boils above about 440° F. and about 90 volume percent boils below about 690° F.

46. A process as defined by claim 43 wherein said catalyst contains between about 3.5 and 6.0 weight percent nickel components, calculated as NiO.

47. A process as defined by claim 41 wherein said effluent from said hydrotreating zone is contacted with said catalyst at a temperature between about 600° F. and 675° F.

48. A process as defined by claim 41 wherein said hydrocarbon feedstock as substantially free of paraffins containing from 1 to 12 carbon atoms.

* * * * *

UNITED STATES PATENT AND TRADEMARK OFFICE

CERTIFICATE OF CORRECTION

PATENT NO. : 5,135,643

DATED : August 4, 1992

INVENTOR(S) : John W. Ward

It is certified that error appears in the above-indentified patent and that said Letters Patent is hereby corrected as shown below:

Column 12, claim 8, line 50, replace "diate" with -- intermediate --; claim 8, line 51, replace "aluminophosphate" with -- silicoaluminophosphate --.

Column 13, claim 22, line 30, replace "Fluoros-" with -- Fluores- --; claim 27, line 53, replace "hydrocarbon" with -- hydrogen --; claim 27, line 57, after "comprising" insert -- an --.

Column 14, claim 37, line 37, replace "750° F." with -- 700° F.--; claim 38, line 39, replace "diesel oil" with -- hydrocarbon --; claim 38, line 40, after "percent" insert -- of said hydrocarbon feedstock --; claim 40, line 45, replace "29" with -- 27 --; claim 41, line 54, replace "suoh" with -- such --; claim 41, line 65, before "essentially" insert -- acidic, --.

Column 15, line 5, after "feedstock" insert -- . --.

Column 16, claim 48, line 13, replace "as" with -- is --.

Signed and Sealed this

Twenty-seventh Day of September, 1994

*Attest:*

Bruce Lehman

BRUCE LEHMAN

*Attesting Officer*

*Commissioner of Patents and Trademarks*